US005246285A

United States Patent [19]

Redburn et al.

[11] Patent Number: 5,246,285

[45] Date of Patent: Sep. 21, 1993

[54] AUTOMATIC INTERIOR LIGHTING DEVICE FOR DRAWERS, CABINETS AND THE LIKE

[76] Inventors: Loren Redburn, 100 Wells Ave., Newton, Mass. 02159; Peter A. Latham, 883 Boylston St., Boston, Mass. 02116

[21] Appl. No.: 861,234

[22] Filed: Mar. 31, 1992

Related U.S. Application Data

[63] Continuation-in-part of Ser. No. 682,469, Apr. 11, 1991, abandoned.

[51] Int. Cl.[5] ..... A47B 77/00; F21V 33/00

[52] U.S. Cl. ..... 312/223.5; 362/155; 362/276; 362/802

[58] Field of Search ..... 312/223.5; 362/802, 362/276, 155; 315/84

[56] References Cited

U.S. PATENT DOCUMENTS 1,874,245 8/1932 Corrigan .
2,411,100 11/1946 Macdonald .
4,178,626 12/1979 Marcus .
4,442,478 4/1984 Stansbury .
4,486,820 12/1984 Baba et al. .
4,757,430 7/1988 Dubak et al. .
4,872,095 10/1989 Dubak et al. .
5,032,957 7/1991 Canfield .
5,034,861 7/1991 Sklenak et al. .
5,036,443 7/1991 Humble et al. .

*Primary Examiner*—Kenneth J. Dorner
*Assistant Examiner*—Gerald A. Anderson
*Attorney, Agent, or Firm*—Hedman, Gibson & Costigan

[57] ABSTRACT

A self-contained automatic lighting device for universal use in furniture, drawers, cabinets, boxes and other enclosures without the need of additional elements comprising a backing plate, cover means, light sources and pivoting switch means wherein said switch means has a contacting face terminating in an extension. The lighting device further includes a photosensor to prohibit activation when light is sensed in the area of the device and timer means to deactivate the light sources after the switch means has been opened for a predetermined period of time.

20 Claims, 7 Drawing Sheets

AUTOMATIC INTERIOR LIGHTING DEVICE FOR DRAWERS, CABINETS AND THE LIKE

REFERENCE TO RELATED APPLICATION

This application is a continuation-in-part of U.S. Ser. No. 07/682,469 filed Apr. 11, 1991, abandoned upon filing hereof.

BACKGROUND OF THE INVENTION

Lighting small places such as furniture, drawers, cabinets, tool, jewelry and fishing boxes has long presented a problem for which no adequate solution has been discovered. Flashlights have to be found before the object sought, compounding the problem. Lights found on the interior of bar cabinets are wired to an outlet and therefore need UL approval and positioning near an outlet, some further requiring the user to manually activate a switch.

The prior art shows several attempts to solve this problem, however, none have been found to be completely acceptable.

A drawer light is described in U.S. Pat. No. 4,178,626 to Marcus which must be manually rotated into its operative position and is fairly large and cumbersome. This device, however, is not made for use in cabinets wherein cabinets do not have the proper mounting surface.

An enclosure light is shown in U.S. Pat. No. 4,442,478 to Stansbury with an automatic switch to activate the light when the drawer or glove compartment enclosure is opened. The device, however, is bulky and does not provide good lighting wherein a single bulb is used which only partially protrudes through a hole in the side of the device.

A cabinet light is described in U.S. Pat. No. 5,032,957 to Canfield. However, the Canfield device is directed solely to cabinets and would not operate in a drawer.

Humble et al (U.S. Pat. No. 5,036,443) relates to a solar charged, battery operated proximity light having a thermal, infrared or sonic activated sensor for when it gets dark, and a mercury switch to activate the light source. The mercury switch requires movement of the devices from a horizontal to a vertical position and when in the vertical position will remained closed, with the light source on. However, drawers and cabinets do not have such horizontal to vertical movement to activate the Humble et al device. Indeed few applications other than on a toilet cover, as suggested by Humble et al, are apparent.

An entrance door light is presented in U.S. Pat. No. 4,872,095 to Dubak et al having a magnetic switch, however, the device is not operable in drawers without an additional mating component for the switch and the light from the device is necessarily directed specifically at the lockset of a door and does not provide broad illumination.

It is therefore an object of the present invention to provide a self-contained automatic lighting device for use in furniture, drawers, cabinets, toolboxes, tackle boxes and the like.

It is a further object to provide a self-contained lighting device for furniture, drawers, cabinets, toolboxes and the like which directs broad lighting into areas such as drawers, cabinets, toolboxes and the like as well as the area in front of the user without excess energy loss.

SUMMARY OF THE INVENTION

These and other objects are achieved by the self-contained automatic enclosure lighting device of the present invention comprising at least one light source directed into the enclosure, switch means associated with said light source, light sensor means to prohibit activation of said light source when a predetermined amount of light is detected in the area of said device regardless of the position of said switch means, timing means to deactivate said light sources after they have been activated for a predetermined period of time and batteries to power the lighting device.

The lighting device comprises housing means having mounting means associated therewith, at least one light source directed into the enclosure, pivotable spring switch means on the exterior of said housing means having an extended activated and a depressed deactivated position and a power source comprising batteries wherein said pivotable switch means further comprises a contacting face terminating in an extension at the moving end of the switch means, said extension to protrude beyond the backing plate in a rearward direction at least when the switch means is depressed. The housing is preferably comprised of a backing plate having the mounting means associated therewith, cover means and translucent lens means over said light source.

The preferred pivotable spring switch means is a pivotable mechanical switch having a flat or cam shaped face for contact with the furniture, drawer frame, cabinet door, box lid or enclosure member utilizing an arc shaped spring electrical contact which places outward pressure on the switch means. When the spring electrical contact is depressed, i.e. when the drawer or cabinet is closed, the arc is deflected to make contact with a lower electrical contact and the circuit is grounded. When the drawer or cabinet is opened, the spring contact pushes up the pivotable switch and, if the light sensor does not detect its threshold of light, the light circuit is energized.

The extension on the moving end of the switch, the end opposite the pivot, is of minimal thickness but extends far enough beyond the back of the device to ensure that the switch will not pop-up inside a drawer, prohibiting opening of the drawer. This is important wherein the face above many drawers are merely a thin member, not much wider than the thickness of the drawer itself. The extension will fit between the top of the face of the drawer and the element above the drawer when the device is properly mounted on the inside face of the drawer.

Similarly, when the device is mounted on the top inside surface of a cabinet, the extension fits between the edge of the top of the cabinet and the door. The extension also aids in the use of the device in other enclosures such as tool, jewelry and tackle boxes with lids that open wherein the lid contacts the extension for activation of the light sources.

The switch design is unique in that it can be used universally on furniture, drawers and cabinets without modification and, further, without the need for a mating plate to depress a plunger or hold a mating magnetic contact.

To reduce power consumption, a light sensor is used, preferably a phototransistor which, when its threshold of light is passed, grounds the circuit. The phototransistor is preferably located on a circuit board within the housing means. Light from the exterior of the device is accessed by the phototransistor through means of an optic light rod located near the switch means. An optional shade can be used to block light from the light rod, thereby removing the effects of the phototransistor and causing the light sources to be energized upon opening of the switch means regardless of the presence of light in the room.

The present invention further utilizes reflective means located on various sides about the light sources to increase the lighting effects in the enclosure, reducing the amount of energy required by allowing a smaller light source. Further to this purpose, the backing plate, at least in the area of the light sources, is colored white or covered with another reflective color or material.

Similarly, the area beneath the lens on the side of the light source against the cover means is preferably colored in a reflective color or material. Additionally, an optional reflective panel is positioned in the lens next to the light sources on the side having the switch to serve the dual purpose of reflecting light into the furniture, drawer or cabinet and keep the light out of the user's eyes.

The lighting device of the present invention is also easily put together. The lens means, preferably clear or frosted acrylic with a textured exterior, has snap together means to engage the cover means. Snap together means are further used for connection of the lenses and cover means to the backing plate. The backing plate has associated with it mounting means for mounting the device in a variety of locations. Means to engage the circuitry, batteries and light sources are preferably associated with the cover means. Preferably, the backing plate, switch means and cover means are made of plastic, and most preferred ABS plastic, by injection molding.

BRIEF DESCRIPTION OF THE DRAWINGS

The attached drawings, in which like reference characters represent like parts, are intended to better illustrate the present invention without limiting the invention in any manner whatsoever.

DETAILED DESCRIPTION OF THE PREFERRED EMBODIMENT

Figure 1:
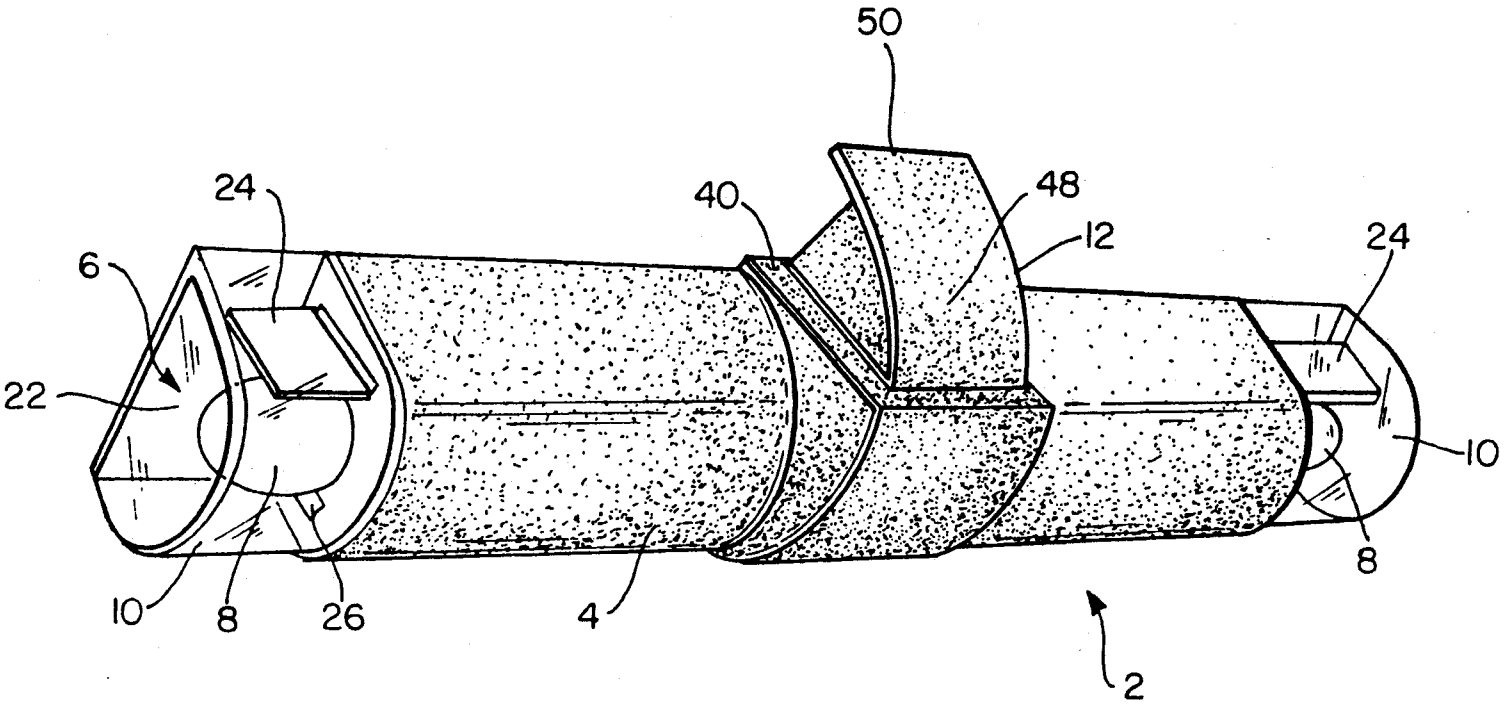
FIG. 1 is a perspective view of the lighting device of the present invention.

The self-contained automatic lighting device 2, as shown in FIG. 1, utilizes housing means comprising a cover 4, a backing plate 6 running across the back of the cover 4 on which the cover 4 is mounted, light sources 8 on each end of the device 2, a lens 10 about each light source 8 and pivoting switch means 12 which works to activate the light sources 8. The device 2 functions utilizing an electrical circuit (shown in FIG. 7) adapted to a printed circuit board 14 located within the cover 4.

The device 2 utilizes circuitry which provides for activation of the light sources 8 when the pivoting spring switch means 12 is not physically depressed. A phototransistor in the circuitry is preferably utilized to prohibit activation of the light sources 8 when sufficient light is detected in the area of the device 2. Timing means to deactivate the light sources 8 after a predetermined amount of time has passed from extension of the switch means 12 is also preferably utilized in the circuitry, as more fully set forth below.

Figure 2A:
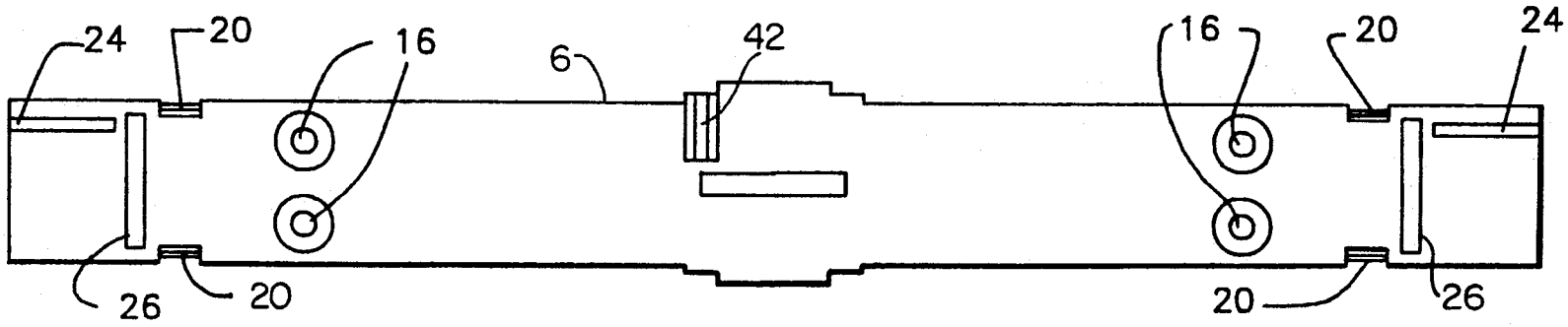
FIG. 2A is an elevational view of the backing plate of the present invention.
Figure 2B:
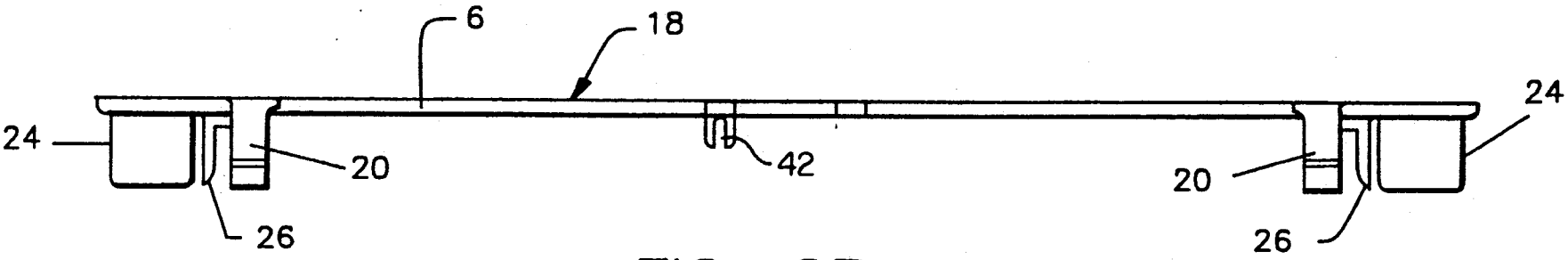
FIG. 2B is a plan view of the backing plate of FIG. 2A.

The backing plate 6, shown individually in FIGS. 2A and 2B, has mounting means associated therewith, including mounting holes 16 for screws, etc., to fit through in various locations to provide mounting in a variety of spaces, or adhesive means such as peel-off adhesive tape, secured to the external side 18 of the backing plate 6. Assembly means, such as snap together tabs 20, allow the housing to open wherein they are directed to the removable attachment of the cover 4 to the backing plate 6.

Also associated with the backing plate 6 are reflective areas 22 located behind the areas in which the light sources 8 are placed and optional reflective panels 24 and 26 to direct the light from the light sources into the furniture, drawer, cabinet, box or other like enclosure. The reflective areas 22 and panels 24 and 26 can be any reflective material or coating, however, white ABS plastic has been found to be the preferred material for the entire backing plate 6, including the reflective areas 22 and reflective panels 24 and 26 formed as a one piece member by injection molding.

Figure 3A:
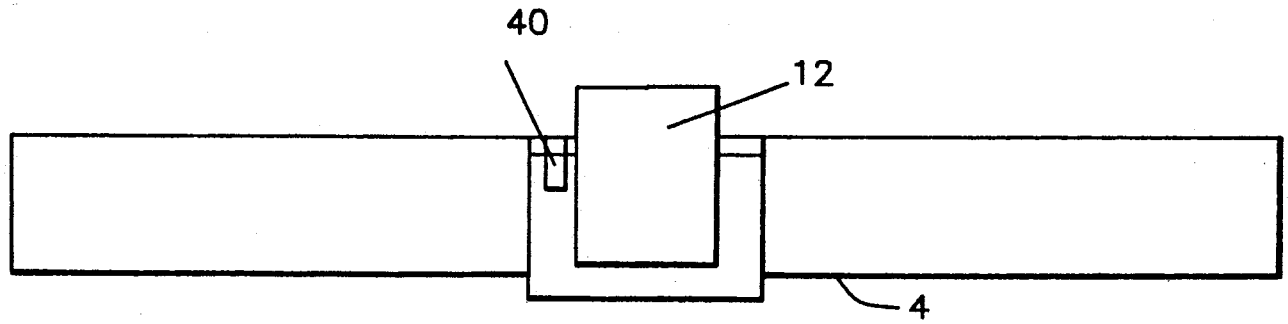
FIG. 3A is a plan view of the cover means of the present invention with the switch in place.
Figure 3B:
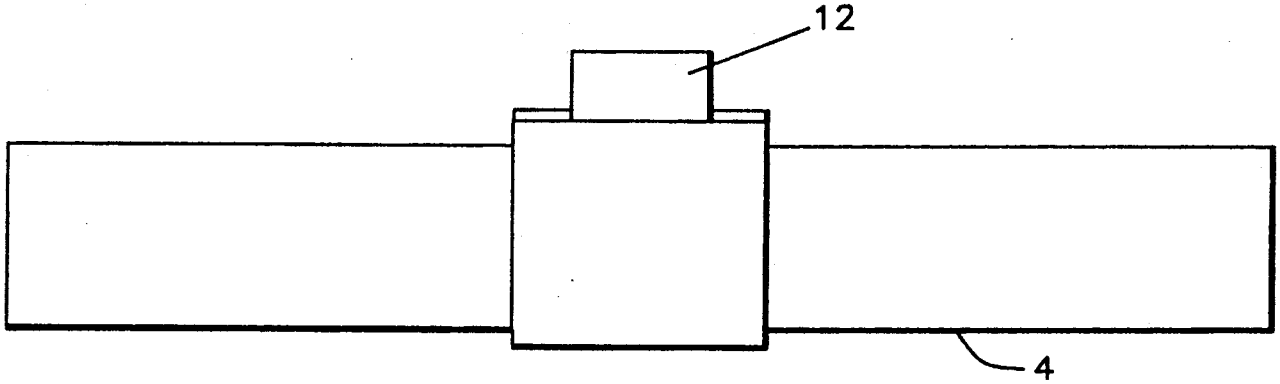
FIG. 3B is a front elevational view of the cover and switch of FIG. 3A.
Figure 3C:
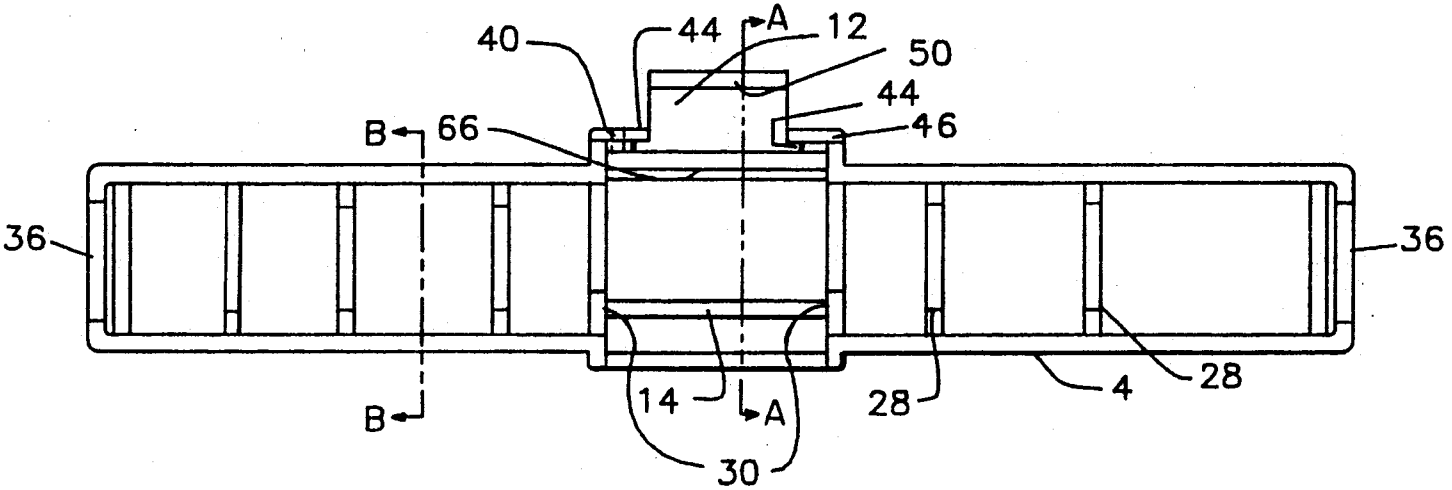
FIG. 3C is a rear elevational view of the cover and switch of FIG. 3A.
Figure 3E:
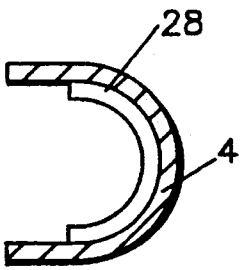
FIG. 3E is a cross sectional view of the cover means through line B—B of FIG. 3C.
Figure 3D:
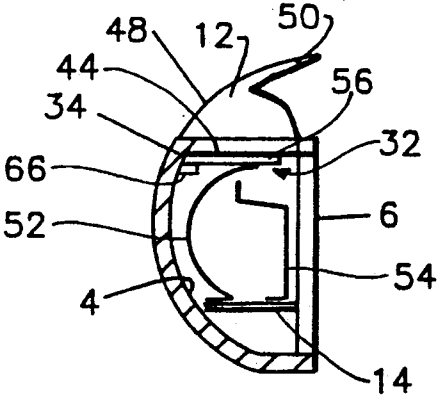
FIG. 3D is a cross sectional view of the cover and switch means, with backing plate and printed circuit board, through line A—A of FIG. 3C.

The cover 4, as shown in FIGS. 3A-3E fits over the backing plate 6 so that the external side of the backing plate 6 is flush with the back edge of the cover 4, as best seen in FIG. 3D. FIG. 3D shows the backing plate 6 and printed circuit board 14 in place within the cover 4, as well as the arc shaped spring means 52 associated with the pivotable switch 12.

The cover 4 is also preferably made of injection molded ABS plastic. The cover 4 includes ribs 28 for holding the batteries in place, a slot 20 for holding the printed circuit board in place, an opening 32 for the switch means 12 to travel in and pivot retention means 34 for the switch means 12 to pivot on. The cover 4 also includes pivot retention means 34 such as a shelf 66 near the top edge of the cover 4 in which the switch means 12 can be snapped into at the pivot 64 thereof, the space above the shelf 66 being just slightly less than the thickness of the pivot 64.

Figure 6:
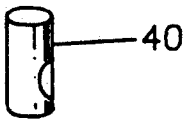
FIG. 6 is a perspective view of the light rod for use with the present invention.

The ends 36 of the cover 4 are open for the light sources 8 to protrude beyond the cover 4 and into the area beneath the lenses 10. The cover 4 also has an aperture 38 in the top next to the switch means 12 which is aligned with an optic light rod 40 (shown in FIG. 6), said light rod 40 being further aligned with the phototransistor on the printed circuit board 14. The light rod 40 is preferably an acrylic rod which allows light to travel along the rod 40 from the exterior to the interior of the cover 4.

As set forth above, the phototransistor works to deactivate the light sources 8 when sufficient light is detected in the area of the device 2, regardless of the switch position. The light rod 40 is held in alignment between the aperture 38 and the phototransistor by retention means 42 on the backing plate 6. An optional shade (not shown) can be utilized to negative the effect of the phototransistor if desired.

Figure 4A:
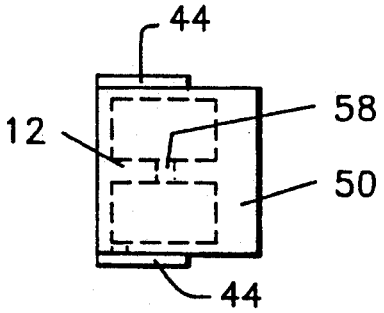
FIG. 4A is a plan view of the switch means of the present invention.
Figure 4B:
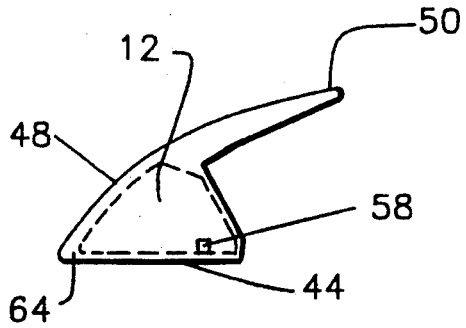
FIG. 4B is a side elevation of the switch of FIG. 4A.

The switch means 12, shown in FIGS. 4A and 4B, pivots on pivot retention means 34 in the cover 4 (as set forth above) within switch opening 32 on the top of the cover 4. The switch means 12 is also preferably made of injection molded ABS plastic. The switch means includes extensions 44 on each side which contact the overhang 46 inside the cover 4 adjacent the switch opening 32 to limit outward movement of the switch means 12 when the spring electrical contact 52 engages the switch means 12. To depress the switch means 12, the furniture, drawer frame, cabinet door, tool, jewelry or tackle box lid, etc. contacts the switch face 48 ending in extension 50, which limits inward movement of the switch means 12.

The switch face 48 is preferably cam shaped to enhance movement of the face 48 on the contacting surface member of the furniture, drawer, cabinet, box or other enclosure.

The extension 50 extends on the moving end of the switch means 12 beyond the back of the device 2 to ensure that the switch will not "pop-up" into the drawer when it is closed, thereby eliminating the need for an additional element in the drawer to contact the switch means 12. The extension 50 also orients the device 2 within the drawer wherein when depressed the extension 50 should lie on the top edge of the face of the drawer. As such, the extension 50 should be of minimum thickness, 1/16" having been found to be acceptable. The extension 50 makes universal the use of the device 2 on furniture, drawers, cabinets, boxes, etc.

The switch means 12 is forced into its extended position by arc shaped spring electrical contact means 52 which, when the switch means 12 is depressed, is deflected to come together with opposed lower contact member 54. The spring contact means 52 has an elongated end 56 which engages a slot 58 in the underside of the switch means 12 for proper orientation.

Figure 5A:
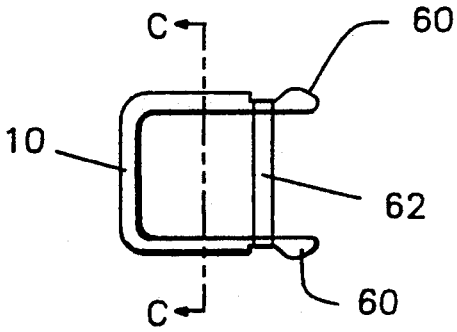
FIG. 5A is an elevation view of the lens means of the present invention.
Figure 5B:
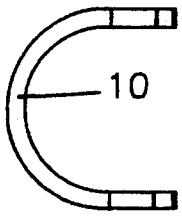
FIG. 5B is a cross sectional view of the lens means through line C—C of FIG. 5A.

During assembly, the lenses 10, shown in FIGS. 5A and 5B, are connected to the cover 4 by snap-in means 60 associated with the open end 62 of the lens nearest the cover 4. The preferred material for the lens 10 is a frosted acrylic having a textured exterior. One lens 10 is located on each side of the device 2 to cover one light source 8 at each end thereby providing light disbursed in all directions for even lighting.

It is contemplated that once the lenses 10 are snapped onto the cover 4 they will not be removed. The snap-in means 60 are also preferably used for engagement of the snap together tabs 20 of the backing plate 6 which ride over the snap-in means 60 and engage same for assembly of the device 2.

Figure 7:
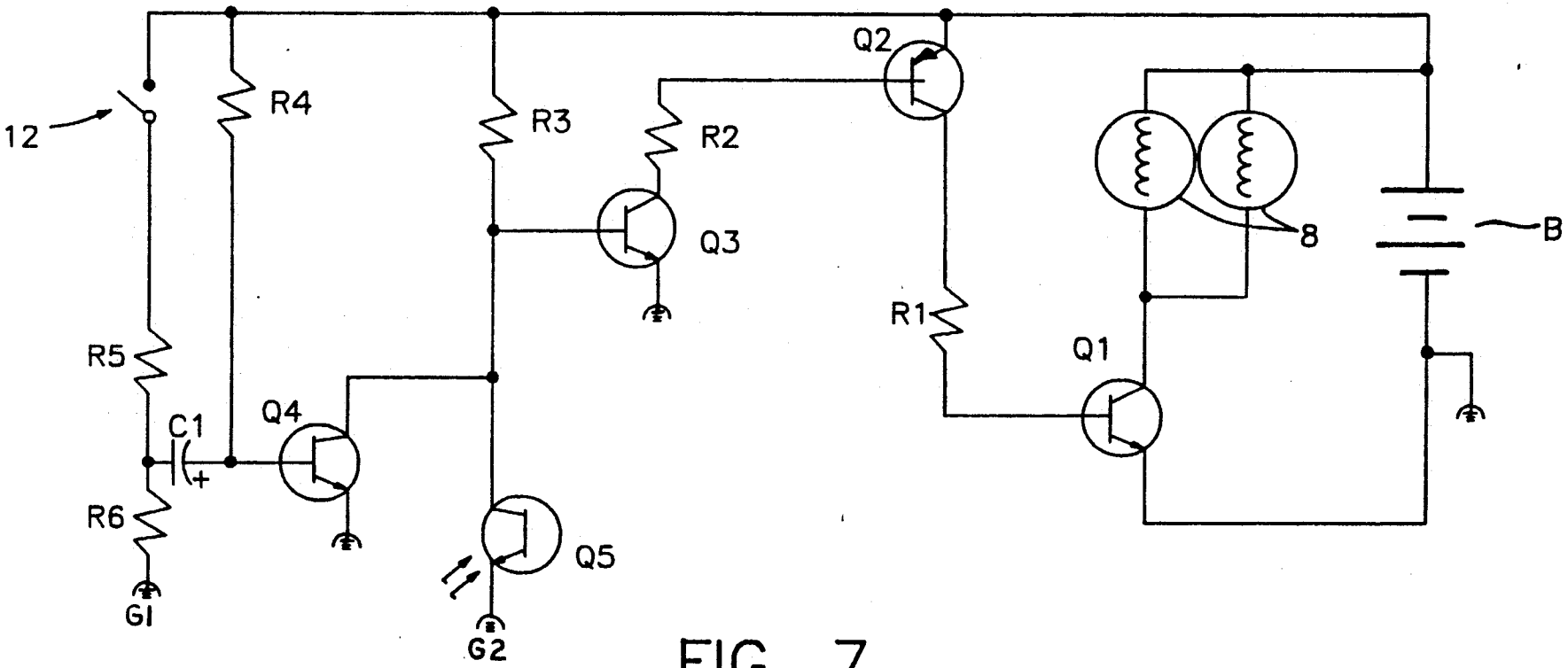
FIG. 7 is a schematic diagram of the circuitry of the present invention.
Figure 8A:
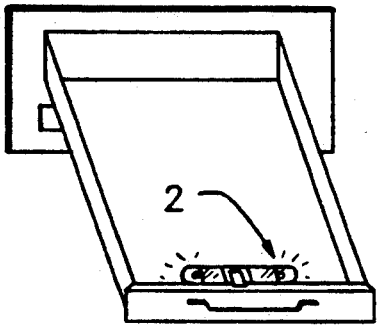
FIG. 8A is a perspective view of the lighting device of the present invention in a drawer.
Figure 8B:
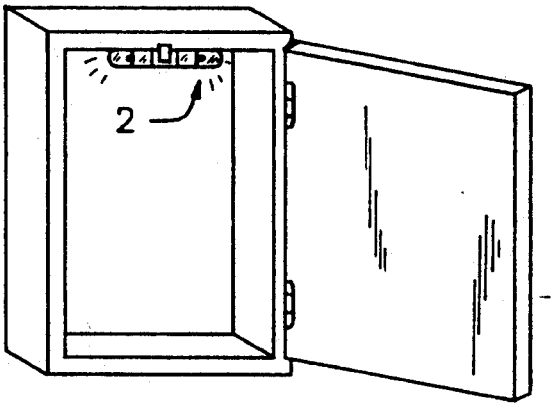
FIG. 8B is a perspective view of the lighting device of the present invention in a cabinet.
Figure 8C:
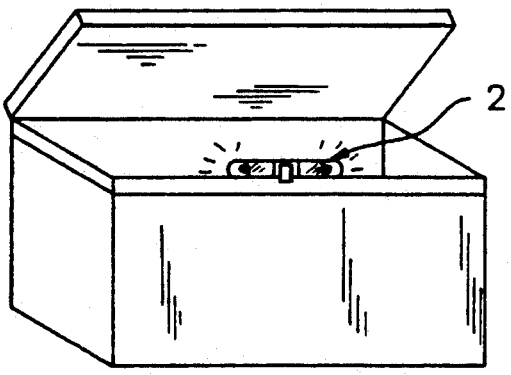
FIG. 8C is a perspective view of the lighting device of the present invention in a box.

The preferred circuit for operation of the device 2 is shown in FIG. 7. Table 1 which follows provides a parts list of the components contemplated for use in creating the circuit of FIG. 7. Where part numbers are specified, they refer to MOTOROLA part numbers.

TABLE 1

| Reference | Type |
|---|---|
| C1 | 10 uF, 6.3 v capacitor |
| Q1 | MPS WO6 transistor |
| Q2 | 2N4403 transistor |
| Q3 | 2N4401 transistor |
| Q4 | 2N4401 transistor |
| Q5 | NPN phototransistor |
| R1 | 56 ¼ w 5% |
| R2 | 2.7k ¼ w 5% |
| R3 | 220k ¼ w 5% |
| R4 | 5M ¼ w 5% |
| R5 | 2.7k ¼ w 5% |
| R6 | 470k ¼ w 5% |
| B | 2 "double A" batteries |

In the circuit of FIG. 7 it is contemplated that when the switch 12 is depressed, not shown, the capacitor C1 charges. When the switch 12 is opened, as shown, transistor Q4 is rendered inactive. Transistor Q4 is held inactive (i.e. below 0.6 volts) for a period of time gauged by resistor R4. For as long as transistor Q4 is held inactive, and the phototransistor Q5 is not detecting light, R3 will feed current to transistor Q3 which draws current through the base of Q2, energizing Q2. When transistor Q2 is energized, current will flow to the collector-emitter junction, through R1 and Q1, thus allowing a much greater current to flow through the light sources 8 and through the collector-emitter junction of Q1, energizing the light sources 8.

The balance of C1 and R4 determines the time needed for the timing circuit to time out. Using the capacitor C1 listed, each megohm of R4 gives about 10 seconds of additional time that the light sources 8 will be energized. Therefore, a 5M resistor, as listed, creates an approximately 50 second timer.

It is understood that various adaptations and modifications of the foregoing can be made without departing from the spirit and scope of the present invention. All such obvious variations are intended to be included in this invention limited only by the appended claims. All references cited are hereby incorporated by reference.

We claim:

1. An automatic enclosure lighting device for use within furniture, drawer, cabinet and box enclosures comprising at least one light source directed into an enclosure, said light source being in an electrical circuit powered by batteries and further comprising switch means movable from an enabling position to a disabling position for enabling and disabling the circuit, means for sensing light associated with means for disabling said circuit when a predetermined amount of light is detected at said device regardless of the position of said switch means and means for timing associated with means for disabling said circuit after said circuit has been enabled for a predetermined period of time.

2. The lighting device of claim 1 wherein the means for sensing light comprises a phototransistor.

3. The lighting device of claim 1 wherein the means for timing comprises a capacitor.

4. The lighting device of claim 1 further comprising a housing and two light sources, one of said light sources at each end of said housing.

5. A self-contained, automatic enclosure lighting device for use within furniture, drawer, cabinet and box enclosures comprising a housing having an exterior, an interior and means for mounting associated therewith, at least one light source directed into an enclosure, pivotable spring search means for activating and deactivating said light source having a pivot end and a moving end on the exterior of said housing means, said spring switch means having an extended activated position and a depressed deactivated position, and a power source comprising batteries, wherein said pivotable switch means further comprises a contacting face terminating in an extension at the moving end of the switch means, said extension to protrude beyond the housing in a direction toward the exterior of the housing associated with the mounting means when the switch means is depressed.

6. The lighting device of claim 5 wherein the housing comprises a backing plate, a cover and a translucent lens over said light source wherein the means for mounting is associated with the backing plate and the cover is attached to the backing plate with removable means for attachment.

7. The lighting device of claim 6 further comprising means for reflecting light associated with said backing plate, behind said light sources in the lens, to direct light into said enclosure.

8. The lighting device of claim 7 further comprising means for reflecting light adjacent the light sources to direct light from the light sources into the enclosure and shield the light from a user's eyes.

9. The lighting device of claim 6 wherein the means for attachment for engagement of the cover and the backing plate comprises snap together means for attachment.

10. The lighting device of claim 6 wherein the lens engages the housing by snap-in means for attachment.

11. The lighting device of claim 5 wherein said housing further comprises lateral ends having translucent lenses associated therewith, one translucent lens located at each lateral end of the housing, each translucent lens having at least one light source located therebeneath.

12. The lighting device of claim 5 further comprising means for sensing light associated with means for deactivating said light source when said means for sensing light detects a predetermined amount of light regardless of the position of the switch means.

13. The lighting device of claim 12 wherein said housing comprises an exterior and an interior, said device further comprising a light rod extending from the exterior of the housing means to the interior of the housing means at a point associated with the means for sensing light.

14. The lighting device of claim 12 wherein the means for sensing light is a phototransistor.

15. The lighting device of claim 5 further comprising means for timing associated with means for deactivating said light source a predetermined length of time after said switch means takes its activated position.

16. The lighting device of claim 15 wherein the means for timing is a capacitor.

17. The lighting device of claim 5 wherein the switch means extends from the housing and is depressed upon contact with said furniture, drawer frame, box lid, cabinet door or enclosure member.

18. The lighting device of claim 5 wherein the switch means further comprises a cam shaped contacting face.

19. The lighting device of claim 5 wherein the switch means engages an arc shaped electrical contact spring so that when the switch means is not depressed the spring is expanded and the light source is activated and when the switch means is depressed the arc shaped electrical contact is deflected for contact with an opposed contact and the light source is deactivated.

20. The lighting device of claim 5 wherein the switch means is pivotably retained in the housing by snap-in means for attachment associated with the pivot end of the switch means.

* * * * *